United States Patent [19]

Poran et al.

[11] Patent Number: 4,942,919

[45] Date of Patent: Jul. 24, 1990

[54] MOLD AND SUPPORT ZONE FOR CONTINUOUS CASTING

[75] Inventors: Michael Poran, Westwood; Carl Langner, Monsey; Shlomo Hury, Woodcliff Lake, all of N.J.

[73] Assignee: SMS Concast, Inc., Montvale, N.J.

[21] Appl. No.: 325,081

[22] Filed: Mar. 17, 1989

Related U.S. Application Data

[63] Continuation of Ser. No. 157,292, Feb. 17, 1988, abandoned.

[51] Int. Cl.[5] ..... B22D 11/04

[52] U.S. Cl. ..... 164/420; 164/436

[58] Field of Search ..... 164/420, 436

[56] References Cited

U.S. PATENT DOCUMENTS

| | | | |
|---|---|---|---|
| 3,717,197 | 2/1973 | Strack et al. | 164/420 |
| 4,532,981 | 8/1985 | Hargassner et al. | 164/420 |
| 4,562,876 | 1/1986 | Hargassner et al. | 164/420 |
| 4,637,452 | 1/1987 | Kawakami | 164/420 |

*Primary Examiner*—Kuang Y. Lin

*Attorney, Agent, or Firm*—Peter K. Kontler; Tobias Lewenstein

[57] ABSTRACT

An apparatus for the continuous casting of slabs has a mold and a slab support zone immediately following the mold. The mold is made up of four separate plates which are held together to define a mold cavity. A dividing wall can be removably mounted in the mold cavity in order to divide the same into a pair of parallel casting passages. Insertion of the dividing wall in the mold cavity makes it possible to simultaneously cast two relatively narrow slabs rather than a single wide slab. A partition designed to constitute an extension of the dividing wall is provided for the support zone and can be removably mounted in the same. Both the dividing wall and the partition are carried by a clamping mechanism which serves to clamp the dividing wall in the mold cavity. The clamping mechanism, which is designed to be mounted on the mold externally of the mold cavity, may be in the form of a frame which circumscribes the mold or may consist of two discrete clamping devices one of which carries the dividing wall and the other of which carries the partition. In the latter case, the clamping device with the partition is mounted at the end of the mold nearest the support zone while the clamping device with the dividing wall is mounted at the opposite end of the mold. The dividing wall has one or more cooling ducts and the clamping mechanism is formed with one or more passages which communicate with the ducts and can be connected to a source of cooling fluid. The partition is provided with spray nozzles for slab cooling and the clamping mechanism is further provided with at least one additional passage for establishing communication between the nozzles and a cooling fluid source.

16 Claims, 3 Drawing Sheets

MOLD AND SUPPORT ZONE FOR CONTINUOUS CASTING

This application is a continuation of application Ser. No. 157,292, filed Feb. 17, 1988, now abandoned.

BACKGROUND OF THE INVENTION

The invention relates generally to a continuous casting apparatus, especially an apparatus for the continuous casting of steel.

More particularly, the invention relates to a continuous casting mold and an associated support zone for a strand formed in the mold.

A mold for the continuous casting of steel slabs is generally made up of two pairs of spaced, parallel copper plates which cooperate to define a mold cavity. The plates of one pair are relatively wide while the plates of the other pair are relatively narrow and the narrow plates are disposed between the wide plates. The plates are held together by clamping elements which exert pressure on the wide plates.

In order to increase the versatility of the mold, it has become known to insert one or more dividing walls in the mold cavity. Such a dividing wall is positioned parallel to the narrow plates and divides the wide mold cavity into two narrower casting passages. This makes it possible to simultaneously cast two relatively narrow slabs instead of a single wide slab.

The dividing wall may be secured to the mold at a fixed location. Although the narrow plates of a slab mold are normally shiftable towards and away from one another in order to change the width of the mold cavity, the range of shifting is limited so that mounting of the dividing wall at a fixed location limits the mix of slab widths. Furthermore, the mold must have provision for attachment of the dividing wall thereby requiring fairly significant modification of the mold. In addition, mounting of the dividing wall on the mold and removal of the dividing wall therefrom are inconvenient.

A dividing wall which is shiftable along the width of the mold cavity is also known. Here, the mold is provided with separate clamping elements for the dividing wall which are likewise shiftable along the width of the mold cavity in order to be aligned with the dividing wall. These elements require special structure which again involves relatively significant modification of the mold. Moreover, the dividing wall is inconvenient to manipulate.

The mold of a slab casting machine is generally followed by a series of support zones for a slab formed in the mold. When a dividing wall is inserted in the mold, it is desirable for the first support zone to have a partition in register with the dividing wall. In conventional machines, the partition is formed as a unit with the first support zone. Since such support zone cannot be used for the casting of a single wide slab, different first support zones must be kept on hand. This not only increases equipment costs but also increases the work required to convert the machine from one which casts a single wide slab to one which casts dual narrow slabs. Thus, the first support zone must be interchanged upon conversion of the machine.

OBJECTS AND SUMMARY OF THE INVENTION

It is an object of the invention to provide a continuous casting apparatus which, without significant modification of the mold, can cast a single strand as well as multiple strands.

Another object of the invention is to provide a continuous casting apparatus which can be converted from single-strand to multiple-strand operation and vice versa with relative ease.

The preceding objects, as well as others which will become apparent as the description proceeds, are achieved by the invention.

One aspect of the invention resides in a continuous casting apparatus, especially an apparatus for the continuous casting of steel. The apparatus comprises wall means defining a mold cavity having two ends which are spaced from one another along a predetermined direction (the casting direction). One of these ends constitutes an inlet for molten material while the other end constitutes an outlet for at least one continuously cast strand of the material. A removable dividing wall is disposed in the mold cavity and extends along the casting direction so as to divide the mold cavity into a pair of substantially parallel casting passages. The apparatus further comprises removable clamping means arranged to exert clamping pressure on the wall means. The clamping means carries the dividing wall and is designed to clamp the latter in the mold cavity at a plurality of locations spaced transversely of the casting direction.

According to the invention, the dividing wall is mounted on the clamping means used to clamp such wall in the mold cavity. The clamping means constitutes a convenient device for manipulating the dividing wall and, since the clamping means is removable, allows the dividing wall to be easily removed from and inserted in the mold cavity. Moreover, inasmuch as the clamping means need not be secured to the wall means defining the mold cavity, no significant modification of the wall means is required in order to mount the dividing wall in the mold cavity. In addition, due to the fact that the clamping means can be positioned at different locations along the mold cavity, a good mix of strand dimensions can be obtained. This enhances the versatility of the continuous casting apparatus.

The apparatus may also comprise strand support means downstream of the mold cavity. When the dividing wall is present in the mold cavity, the strand support means may accommodate a partition which is in alignment with the dividing wall and, like the latter, extends along the casting direction. In accordance with a preferred embodiment of the invention, the partition is removable and is mounted on the clamping means. This not only provides the advantages outlined above for the dividing wall but further makes it possible to use the strand support means for both single-strand and multiple-strand operation.

The novel features which are considered as characteristic of the invention are set forth in particular in the appended claims. The improved continuous casting apparatus itself, however, both as to its construction and its mode of operation, together with additional features and advantages thereof, will be best understood upon perusal of the following detailed description of certain specific embodiments when read in conjunction with the accompanying drawings.

DESCRIPTION OF THE PREFERRED EMBODIMENTS

Figure 1:
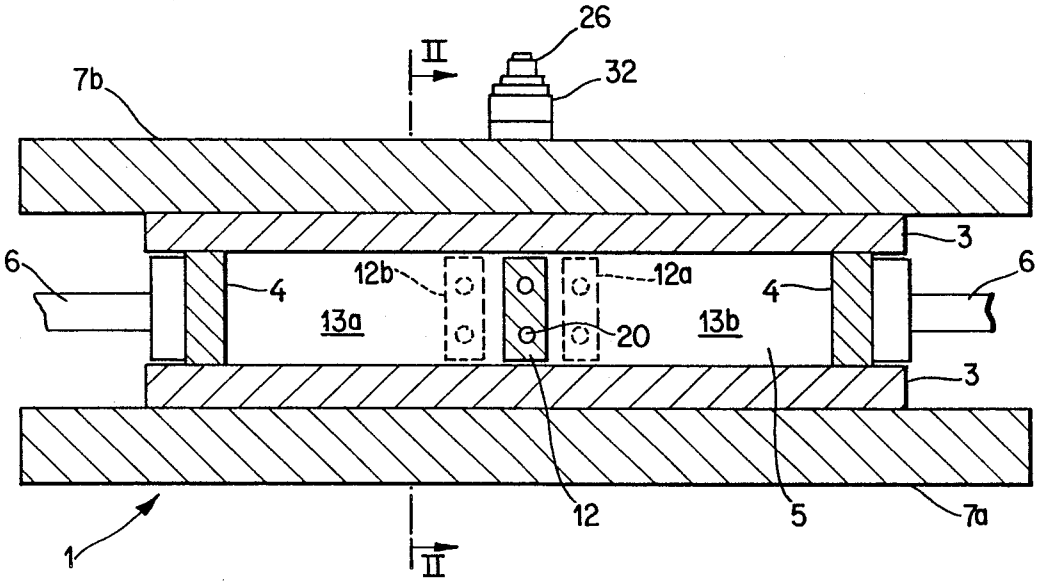
FIG. 1 is a schematic horizontal sectional view through a continuous casting mold with one embodiment of a clamping mechanism according to the invention.
Figure 2:
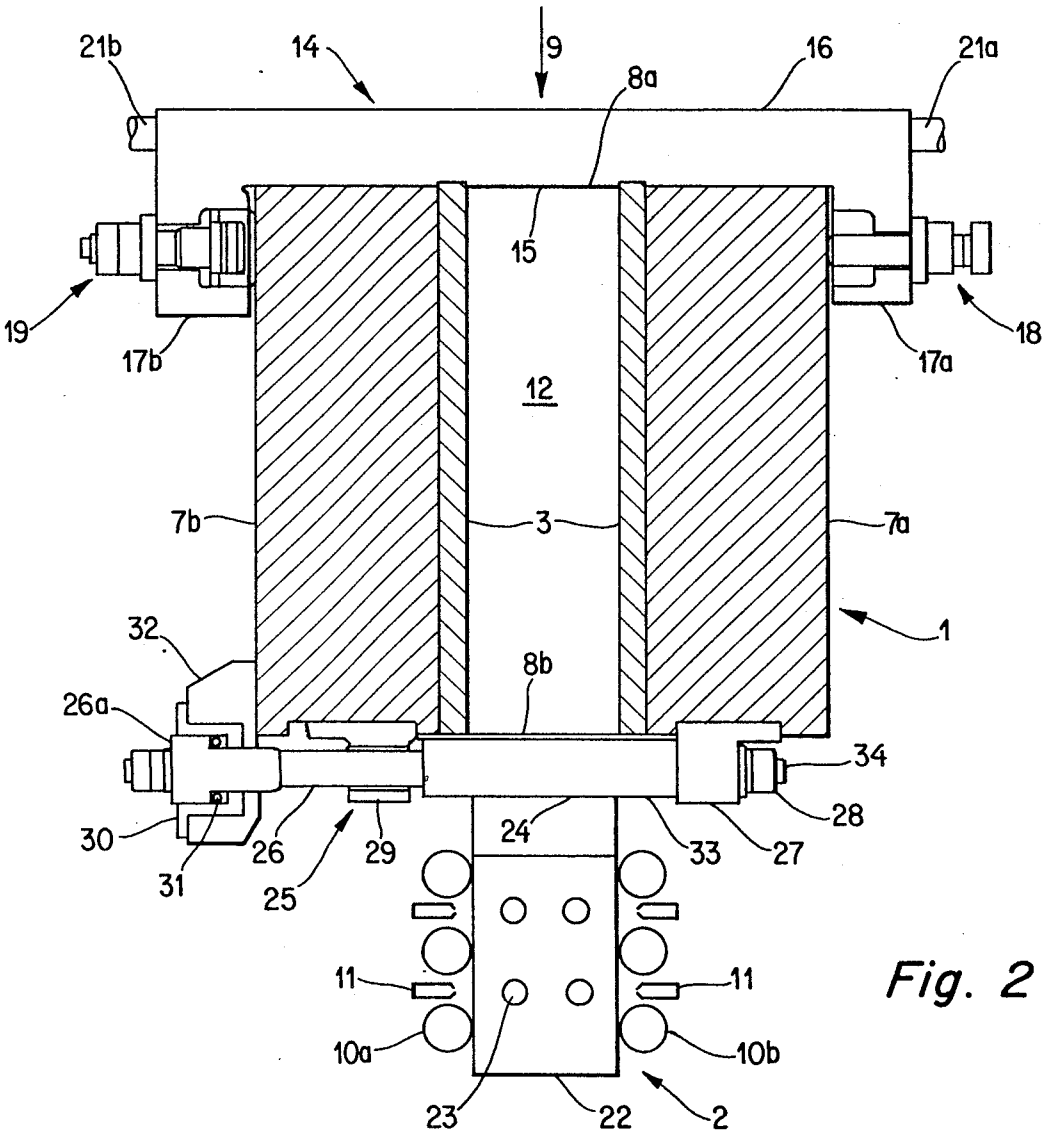
FIG. 2 is a sectional view as seen in the direction of the arrows II—II of FIG. 1 with parts of the clamping mechanism broken away.

Referring to FIGS. 1 and 2, the reference numerals 1 and 2 generally identify respective components of a continuous casting apparatus. The component 1 is a continuous casting mold while the component 2 is a support zone for continuously cast strands formed in the mold 1. The continuous casting apparatus is here assumed to be of the vertical straight-mold type or curved-mold type and is further assumed to be designed for the continuous casting of steel.

The mold 1 includes a pair of wide walls 3 in the form of one-piece copper plates and a pair of narrow walls 4 which are likewise in the form of copper plates. The walls 3 are spaced from and parallel to one another as are the walls 4 (as a rule, the walls 4 are not exactly parallel but have a very slight inclination to compensate for slab shrinkage). The narrow walls 4 are disposed between the wide walls 3 and cooperate with the latter to define a mold cavity 5 of rectangular cross section. The narrow walls 4 are connected with conventional drives 6 which allow the walls 4 to be moved towards and away from one another in order to change the width of the mold cavity 5.

The wide walls 3 are mounted on respective back-up plates 7*a* and 7*b* in the usual manner. The back-up plate 7*a* is fixed whereas the back-up plate 7*b* can undergo limited movement towards and away from the back-up plate 7*a* in order to insert and remove the narrow walls 4. Furthermore, the wide walls 3 and narrow walls 4 are cooled in a conventional fashion by a circulating cooling fluid, typically water. The wide walls 3 and narrow walls 4 are held in engagement with one another by non-illustrated clamping bolts or the like of known construction.

The preceding description of the mold 1 indicates that the latter is designed for the casting of slabs, i.e., the continuous casting apparatus is a slab casting apparatus.

The mold cavity 5 has an open first end 8*a* which constitutes an inlet for molten steel and an open second end 8*b* which constitutes an outlet for a continuously cast steel slab formed in the mold cavity 5. The inlet end 8*a* and outlet end 8*b* are spaced from one another along a predetermined direction 9 known as the casting direction and steel moves through the mold cavity 5 in such direction. In operation, the mold 1 has a generally vertical orientation so that the inlet end 8*a* is located above the outlet end 8*b* and the casting direction 9 is downwards.

The support zone 2 is disposed immediately downstream of the mold 1 and constitutes the first of a series of conventional slab support zones which follow the mold 1 as considered in the casting direction 9. The support zones downstream of the support zone 2 have not been illustrated since this is not necessary for an understanding of the invention.

The support zone 2 which, as indicated, is conventional, includes a first row of rolls 10*a* in alignment with one of the wide walls 3 of the mold 1 and a second row of rolls 10*b* in alignment with the other of the wIde walls 3. The rolls 10*a*, 10*b* serve to support the wide faces of a slab issuing from the mold cavity 5. Spray nozzles 11 for slab cooling may be disposed between neighboring rolls 10*a* and neighboring rolls 10*b*.

A dividing wall 12 is disposed in the mold cavity. The dividing wall 12 is parallel to the narrow mold walls 4 and extends in the casting direction 9. The length of the dividing wall 12, as considered in the casting direction 9, is similar to that of the mold walls 3, 4. The dividing wall 12 divides the mold cavity 5 into a pair of parallel casting passages 13*a* and 13*b*.

The dividing wall 12 is removable from the mold cavity 5. In the absence of the dividing wall 12, the mold 1 will produce a slab having a width equal to the distance between the narrow mold walls 4. On the other hand, when the dividing wall 12 is present in the mold cavity 5, the mold 1 can generate two slabs of lesser width. One of these slabs will have a width equal to the distance between the dividing wall 12 and a first one of the narrow mold walls 4 while the other will have a width equal to the distance between the dividing wall 12 and the second narrow mold wall 4.

The dividing wall 12 is secured, e.g. bolted, at 15 to a clamping device 14 located at the top of the mold 1. The clamping device 14 resembles an inverted U and embraces the mold 1. Thus, the clamping device 14 includes an elongated web 16 constituting a slab or block and two arms 17*a* and 17*b* projecting downwards from the respective ends of the web 16. The web 16 extends transversely of the mold 1 from the back-up plate 7*a* to the back-up plate 7*b* and the arm 17*a* is located outwardly adjacent to the back-up plate 7*a* while the arm 17*b* is located outwardly adjacent to the back-up plate 7*b*. The web 16 is provided with recesses which are designed to receive the upper ends of the wide mold walls 3.

The clamping device 14 serves to clamp the upper end of the dividing wall 12 in the mold cavity 5. To this end, the clamping device 14 further includes a clamping element 18, e.g., a clamping bolt, which is mounted on the arm 17*a* and bears against the outer surface of the back-up plate 7*a*. In addition, a yieldable biasing element 19, which is here in the form of a hydraulic cylinder, is mounted on the arm 17*b* and bears against the outer surface of the back-up plate 7*b*. The biasing element 19 functions to compensate for thermal expansion and contraction of the dividing wall 12, i.e., the biasing element 19 contracts in response to thermal expansion of the dividing wall 12 and vice versa.

The dividing wall 12, which may consist of copper like the mold walls 2, 3, is formed with cooling ducts 20 for circulation of a cooling fluid, typically water. The clamping device 14 is provided with pipes 21*a* and 21*b* which communicate with the ducts 20. The pipe 21*a* is connected to a non-illustrated source of water and serves to admit water into the ducts 20 while the pipe 21*b* serves to discharge water from the ducts 20.

The clamping device 14 is located virtually entirely outside of the mold cavity 5. This allows the clamping device 14, and hence the dividing wall 12, to be manipulated with relative ease.

The clamping element 18 and biasing element 19 of the clamping device 14 exert clamping pressure directly on the back-up plates 7*a*, 7*b* of the mold 1 and indirectly on the wide mold walls 3 via the back-up plates 7*a*, 7*b*. Upon release of the clamping element 18, the clamping device 14 is removable from the mold 1 together with the dividing wall 12.

The mold 1 and clamping device 14 are designed in such a manner that the clamping device 14, and therefore the dividing wall 12, can be situated at a multiplicity of locations across the width of the mold cavity 5. For instance, the clamping device 14 and dividing wall 12 can be positioned at the center of the mold cavity 5 as indicated by the full line showing of the dividing wall 12; somewhat to the right of center as indicated by the phantom line showing 12*a* of the dividing wall 12; or somewhat to the left of center as indicated by the phantom line showing 12*b* of the dividing wall 12. The design of the mold 1 and clamping device 14 such that the dividing wall 12 can be positioned at different locations across the width of the mold cavity 5 enables a good mix of slab widths to be obtained when casting dual slabs. This enhances the versatility of the continuous casting apparatus.

A partition 22 is disposed in the support zone 2. The partition 22 essentially forms a continuation of the dividing wall 12 and divides the support zone 2 into a pair of passages each of which is in register with one of the casting passages 13*a*, 13*b* in the mold 1. Thus, the partition 22 is in alignment with the dividing wall 12 and, like the latter, extends in the casting direction 9. The partition 22 carries spray nozzles 23 which are arranged to spray the narrow faces of slabs issuing from the mold 1 with a cooling fluid, typically water.

The partition 22 is removable from the support zone 2. When the dividing wall 12 is present in the mold cavity 5 during a casting operation, the partition 22 should be present in the support zone 2. Similarly, when the dividing wall 12 is removed from the mold cavity 5 for a casting operation, the partition 22 should be removed from the support zone 2.

The partition 22 is secured, e.g., bolted, at 24 to a second clamping device 25 which is separated from the clamping device 14 and is located at the bottom of the mold 1. The clamping device 25 serves the dual functions of clamping the lower end of the dividing wall 12 in the mold cavity 5 and holding the partition 22 in position in the support zone 2. The clamping device 25 includes a clamping element which is here in the form of a bolt 26. The bolt 26 extends transversely of the mold 1 from the back-up plate 7*a* to the back-up plate 7*b*. The clamping device 25 further includes a block 27 which is snugly received in a recess formed in the lower surface of the back-up plate 7*a* and is secured to the latter. The bolt 26 passes through the block 27 and has an exposed end portion on the side of the block 27 remote from the back-up plate 7*b*. A clamping nut 28 is mounted on the exposed end portion of the bolt 26.

The clamping device 25 additionally includes a second block 29. The block 29 is received with clearance in a recess formed in the lower surface of the back-up plate 7*b* and is secured to the plate 7*b*. The bolt 26 extends through the block 29 which can slide relative to the bolt 26.

The bolt 26 has an enlarged head 26*a* which is located near the external surface of the back-up plate 7*b* and cooperates with a collar 30 of Z-shaped cross section to define an annular space circumscribing the bolt 26. A blasting element 31, e.g., an elastomeric ring, is accommodated in this space. The collar 30 carries a bearing ring 32 which abuts the external surface of the back-up plate 7*b* and is confined between the collar 30 and such surface.

Similarly to the biasing element 19 of the clamping device 14, the biasing element 31 of the clamping device 25 functions to compensate for thermal contraction and expansion of the dividing wall 12.

A jacket 33 constituting a manifold circumscribes the bolt 26 between the blocks 27 and 29 and a pipe 34 connected to a non-illustrated source of cooling fluid, typically water, opens into the interior of the jacket 33. The partition 22 is mounted on the jacket 33 and is provided with conduits or passages which connect the spray nozzles 23 with the interior of the jacket 33. Thus, water enters the jacket 33 via the pipe 34 and is discharged through the spray nozzles 23.

The clamping device 25 is again located virtually entirely outside of the mold cavity 5. Accordingly, the clamping device 25, and hence the partition 22, can be manipulated with relative ease.

When the clamping nut 28 is tightened, the block 27 and bearing ring 32 of the clamping device 25 exert clamping pressure directly on the back-up plates 7*a*, 7*b*, which in turn, exert clamping pressure on the mold walls 3. On the other hand, when the clamping nut 28 is loosened and the block 27 and bearing ring 32 are released from the back-up plates 7*a*, 7*b* the clamping device 25 is removable from the mold 1 and support zone 2 together with the partition 22. This allows the support zone 2 to be used for the casting of a single wide slab as well as dual narrower slabs.

As before, the mold 1 and clamping device 25 are designed so that the clamping device 25, and therefore the partition 22, can be mounted at various positions across the width of the mold cavity 5.

When the dividing wall 12 is present in the mold cavity 5, the dividing wall 12 in essence constitutes a third narrow mold wall which functions to form one narrow face of each of the two slabs generated in the respective casting passages 13*a*, 13*b*. The partition 22 can support these narrow faces in the support zone 2 if necessary.

Figure 3:
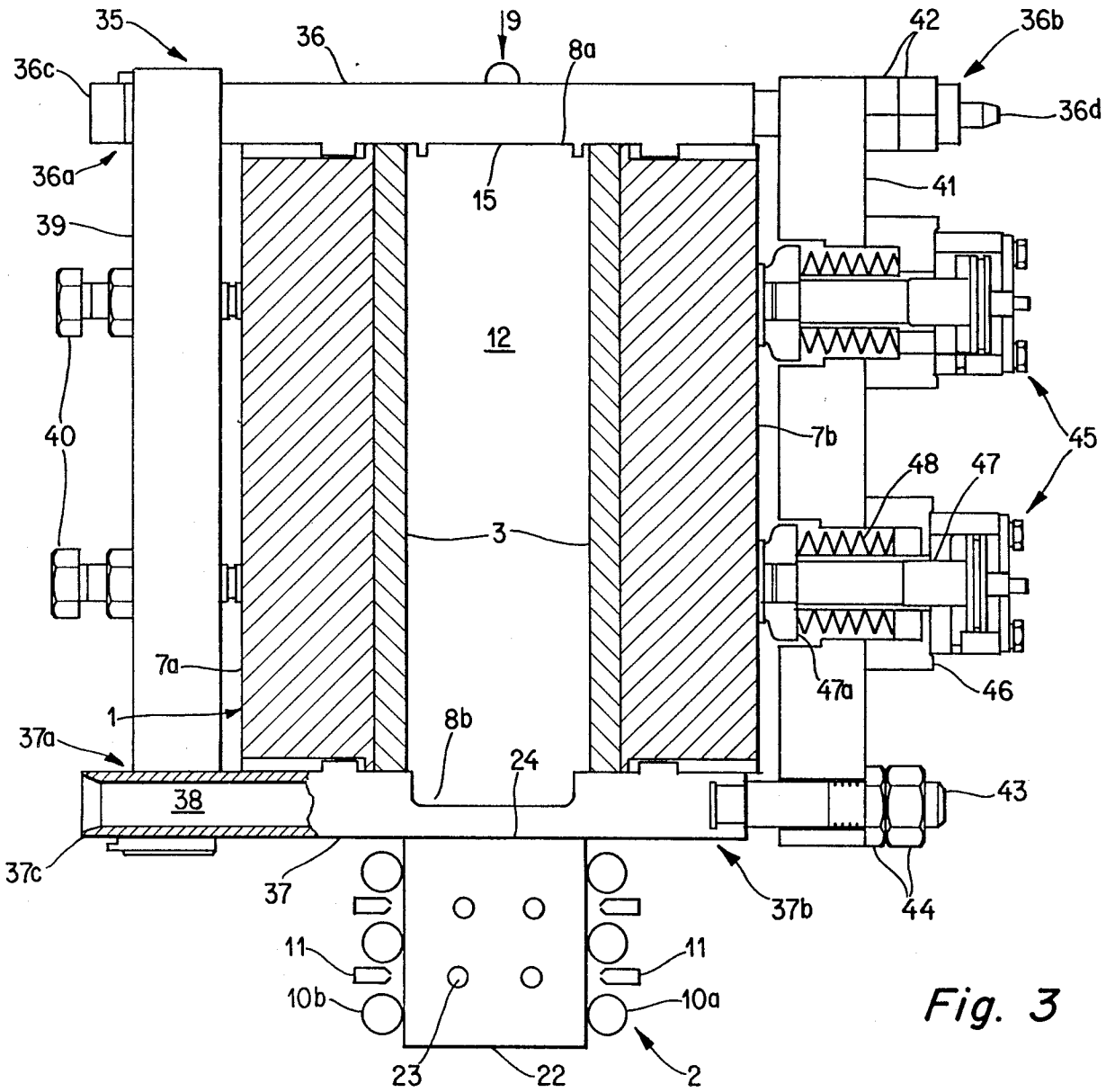
FIG. 3 is a partly broken away, partly sectional view similar to FIG. 2 but showing another embodiment of the clamping mechanism.

In FIGS. 1 and 2, the clamping means for the dividing wall 12 comprises two discrete clamping devices 14 and 25. FIG. 3, in which the same reference numerals as in FIGS. 1 and 2 are used to identify similar elements, illustrates a clamping device or means 35 which is in the form of a single unit and frames or circumscribes the mold 1.

With reference now to FIG. 3, the clamping device 35 includes a transverse upper strap or block 36 which extends across the top of the mold 1 from the back-up plate 7*a* to the back-up plate 7*b*. The strap 36 has a first end portion 36*a* located outwardly of the back-up plate 7*a* and a second end portion 36*b* located outwardly of the back-up plate 7*b*. The dividing wall 12 is secured to the strap 36 and the latter has internal cooling passages which communicate with the cooling ducts 20 in the dividing wall 12. The end portion 36*a* of the strap 36 is provided with a junction 36*c* for connecting the strap 36 to a non-illustrated source of cooling fluid, typically water, while the end portion 36*b* is provided with a nipple 36*d* for discharge of the cooling fluid.

The upper surface of each of the back-up plates 7*a*, 7*b* is formed with a cutout which leaves the top of the respective back-up plate 7*a*, 7*b* with a narrow upstanding rim adjacent to the associated wide mold wall 3. The strap 36 has a depending protuberance on either side of the dividing wall 12 and each protuberance cooperates with the dividing wall 12 to define a recess. The upstanding rim of the back-up plate 7*a* and the upper end of the associated wide mold wall 3 are received in one of these recesses with clearance while the upstanding rim of the back-up plate 7*b* and the upper end of the associated wide mold wall 3 are received in the other recess with clearance.

The clamping device 35 further includes a transverse lower strap or block 37 which extends across the bottom of the mold 1 from the back-up plate 7*a* to the back-up plate 7*b*. The strap 37 has a first end portion 37*a* located outwardly of the back-up plate 7*a* and a second end portion 37*b* located below the back-up plate 7*b*. The partition 22 is secured to the strap 37 and the latter is formed with a cooling passage 38 which extends from the end portion 37*a* to the partition 22. The end portion 37*a* of the strap 37 is provided with a junction 37*c* for connecting the strap 37 to a source of cooling fluid, typically water. The strap 37 constitutes a manifold at its connection with the partition 22 to thereby establish communication between the cooling passage 38 and the conduits or passages of the partition 22 which lead to the spray nozzles 23.

The lower surface of each of the back-up plates 7*a*, 7*b* has a cutout which leaves the bottom of the respective back-up plate 7*a*, 7*b* with a narrow depending rim adjacent to the associated wide mold wall 3. The strap 37 has an upstanding protuberance on either side of the dividing wall 12 and each protuberance cooperates with the dividing wall 12 to define a recess. The depending rim of the back-up plate 7*a* and the lower end of the associated wide mold wall 3 are received in one of these recesses with clearance while the depending rim of the back-up plate 7*b* and the lower end of the associated wide mold wall 3 are received in the other recess with clearance.

The clamping device 35 additionally includes a first longitudinal strap or block 39 located to the outside of the back-up plate 7*a* and extending lengthwise of the latter, i.e., along the height of the back-up plate 7*a*. The end portion 36*a* of the transverse upper strap 36 passes through the upper end portion of the strap 39 and such end portions are held together in any suitable manner. Similarly, the end portion 37*a* of the transverse lower strap 37 extends through the lower end portion of the strap 39 with the end portions again being connected to one another.

The longitudinal strap 39 carries two spaced clamping elements 40, here shown as being in the form of bolts. The clamping bolts 40 bear against the external surface of the back-up plate 7*a*.

The clamping device 35 also includes a second longitudinal strap or block 41 located to the outside of the back-up plate 7*b* and extending lengthwise thereof, i.e., along the height of the back-up plate 7*b*. The end portion 36*b* of the transverse upper strap 36 passes through the upper end portion of the strap 41 so that the end portion 36*b* has an exposed part on the side of the strap 41 remote from the back-up plate 7*b*. The exposed part of the end portion 36*b* is threaded and mates with clamping nuts 42. A further clamping element in the form of a screw 43 is mounted in the lower end portion of the strap 41 and threaded into the end portion 37*b* of the transverse lower strap 37. The screw 43 has an exposed part on the side of the strap 41 remote from the back-up plate 7*b* and nuts 44 are threaded onto such exposed part of the screw 43. The clamping nut 42, screw 43 and nuts 44 function to hold the straps 36, 37, 39, 41 together.

The longitudinal strap 41 carries two spaced biasing devices 45. Each of the biasing devices 45 includes a housing 46 which is fixed to that side of the strap 41 remote from the back-up plate 7*b*. A plunger 47 rides in each housing 46 and has an enlarged head 47*a* which is arranged to bear against the external surface of the back-up plate 7*b*. A biasing element in the form of a compression spring 48 is interposed between each of the housings 46 and the enlarged head 47*a* of the associated plunger 47 and urges the enlarged head 47*a* into engagement with the external surface of the back-up plate 7*b*. The biasing devices 45 serve to compensate for thermal expansion and contraction of the dividing wall 12.

Unlike the clamping means 14, 25 of FIGS. 1 and 2, the clamping means or device 35 of FIG. 3 constitutes a single unit during use. This unit resembles a frame which circumscribes the mold 1. On the other hand, similarly to the clamping means 14, 25 of FIGS. 1 and 2, the clamping device 35 is located substantially entirely outside of the mold cavity 5.

When the clamping bolts 40 are tightened, the clamping bolts 40 and biasing devices 45 exert clamping pressure on the back-up plates 7*a*, 7*b* which, in turn, act on the wide mold walls 3. This causes the dividing wall 12 to be clamped in the mold cavity 5. Upon loosening the clamping bolts 40 and nuts 42, 44, the clamping device 35 and dividing wall 12 are removable from the mold 1 while the partition 22 is removable from the support zone 2.

The mold 1 and clamping device 35 are designed in such a manner that the clamping device 35, and accordingly the dividing wall 12 and partition 22, can be positioned at any desired location across the width of the mold cavity 5. This may be achieved without extensive modification of the mold 1.

Without further analysis, the foregoing will so fully reveal the gist of the present invention that others can, by applying current knowledge, readily adapt it for various applications that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A continuous casting apparatus, comprising wall means defining a mold cavity having two ends which are spaced from one another along a predetermined direction, one of said ends constituting an inlet for molten material and the other of said ends constituting an outlet for at least one continuously cast strand of the material; strand support means including a first strand support zone arranged to be located immediately downstream of said cavity and defining a strand guide channel designed to extend along said predetermined direction in substantial alignment with said cavity; a dividing wall designed to be removably mounted in said cavity so as to extend along said predetermined direction and thereby divide said cavity into a pair of substantially parallel casting passages; a partition designed to be removably positioned in said channel so as to extend along said predetermined direction in substantial alignment with said dividing wall and thereby divide said channel into a pair of substantially parallel guide passages, said partition being designed to extend along at least the major part of said channel; and clamping means designed to be removably mounted on said wall means so as to exert clamping pressure on the same, said clamping means being designed to carry said dividing wall and to clamp the latter in said cavity, and said clamping means further being designed to carry said partition.

2. The apparatus of claim 1, further comprising strand cooling means on said partition; and wherein said clamping means is provided with cooling fluid supply means arranged to communicate with said strand cooling means.

3. The apparatus of claim 2, wherein said dividing wall is provided with a cooling duct and said clamping means is provided with additional cooling fluid supply means arranged to communicate with said duct.

4. The apparatus of claim 1, wherein said clamping means comprises a first portion designed to carry said dividing wall and a second portion designed to carry said partition, said first and second portions being in the form of a unit when said clamping means exerts clamping pressure on said wall means.

5. The apparatus of claim 1, wherein said clamping means comprises a first portion designed to carry said dividing wall and a discrete second portion designed to carry said partition.

6. The apparatus of claim 1, wherein said dividing wall is provided with a cooling duct and said clamping means is provided with cooling fluid supply means arranged to communicate with said duct.

7. The apparatus of claim 1, wherein said clamping means comprises a biasing element designed to yield in response to expansion and contraction of said dividing wall.

8. The apparatus of claim 7, wherein said biasing element is resilient.

9. The apparatus of claim 1, wherein said clamping means is designed to be located externally of said cavity substantially in its entirety.

10. The apparatus of claim 9, wherein said clamping means comprises a portion designed to carry said dividing wall and to embrace said wall means.

11. The apparatus of claim 9, wherein said clamping means is designed to frame said wall means.

12. The apparatus of claim 1, wherein said wall means comprises first and second pairs of spaced mold walls which cooperate to define said cavity.

13. The apparatus of claim 12, wherein the mold walls of said first pair are shiftable towards and away from one another to change the dimensions of said cavity.

14. The apparatus of claim 13, wherein the mold walls of said first pair are narrower than the mold walls of said second pair.

15. The apparatus of claim 14, wherein the mold walls of each pair are substantially parallel to one another, said dividing wall being arranged to extend in substantial parallelism with the mold walls of said first pair.

16. The apparatus of claim 1, wherein said clamping means is designed to clamp said dividing wall in said cavity at a plurality of locations spaced transversely of said predetermined direction.

* * * * *